United States Patent [19]

Bridgewater et al.

[11] Patent Number: 4,887,757

[45] Date of Patent: Dec. 19, 1989

[54] FIXATION STAKE FOR BENTHIC BARRIER

[75] Inventors: Todd J. Bridgewater, Freeland; John E. Plott, Midland, both of Mich.

[73] Assignee: Dow Corning Corporation, Midland, Mich.

[21] Appl. No.: 197,781

[22] Filed: May 23, 1988

[51] Int. Cl.[4] ..... B25C 7/00

[52] U.S. Cl. ..... 227/147; 227/156; 254/1

[58] Field of Search ..... 227/147, 156, 68; 173/90, 91, 30, 129, 134; 411/451, 480, 395, 396, 907, 908; 405/258; 29/275; 254/29 R, 30, 1; 175/19, 20, 135, 230, 257; 81/3.48, 3.49, 44; 111/92, 98

[56] References Cited

U.S. PATENT DOCUMENTS

| | | | |
|---|---|---|---|
| 1,482,745 | 2/1924 | Heid | 173/129 X |
| 1,583,409 | 5/1926 | Marquart | 254/29 R |
| 2,147,828 | 2/1939 | Daniels | 173/90 X |
| 2,432,650 | 12/1947 | Bezzerides | 254/1 |
| 2,802,297 | 8/1957 | Meyer | 411/480 X |
| 3,395,625 | 8/1968 | Blanchette et al. | 411/908 X |
| 4,056,936 | 11/1977 | Mayer | 405/258 |
| 4,191,116 | 3/1980 | Allison, Jr. et al. | 111/92 X |
| 4,556,114 | 12/1985 | Ryan | 175/20 |
| 4,609,170 | 9/1986 | Schnabl | 411/451 X |
| 4,706,861 | 11/1987 | Jacobsen et al. | 277/147 X |

*Primary Examiner*—Donald R. Schran
*Assistant Examiner*—James L. Wolfe
*Attorney, Agent, or Firm*—Allan O. Maki

[57] ABSTRACT

A fixation stake for securing articles such as benthic barriers to the earth comprising hollow thin-walled elongated plastic body and an enlarged head portion at one end thereof, and a method and apparatus for inserting the stakes into the ground comprising a rod portion of a size suitable to be inserted through the hollow bore of the stakes, the apparatus having an upright handle portion and a horizontal foot peddle for insertion of the stakes into the ground.

3 Claims, 3 Drawing Sheets

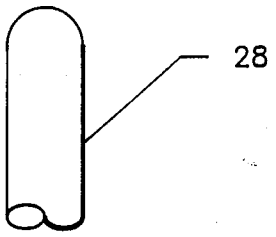
FIG. 3
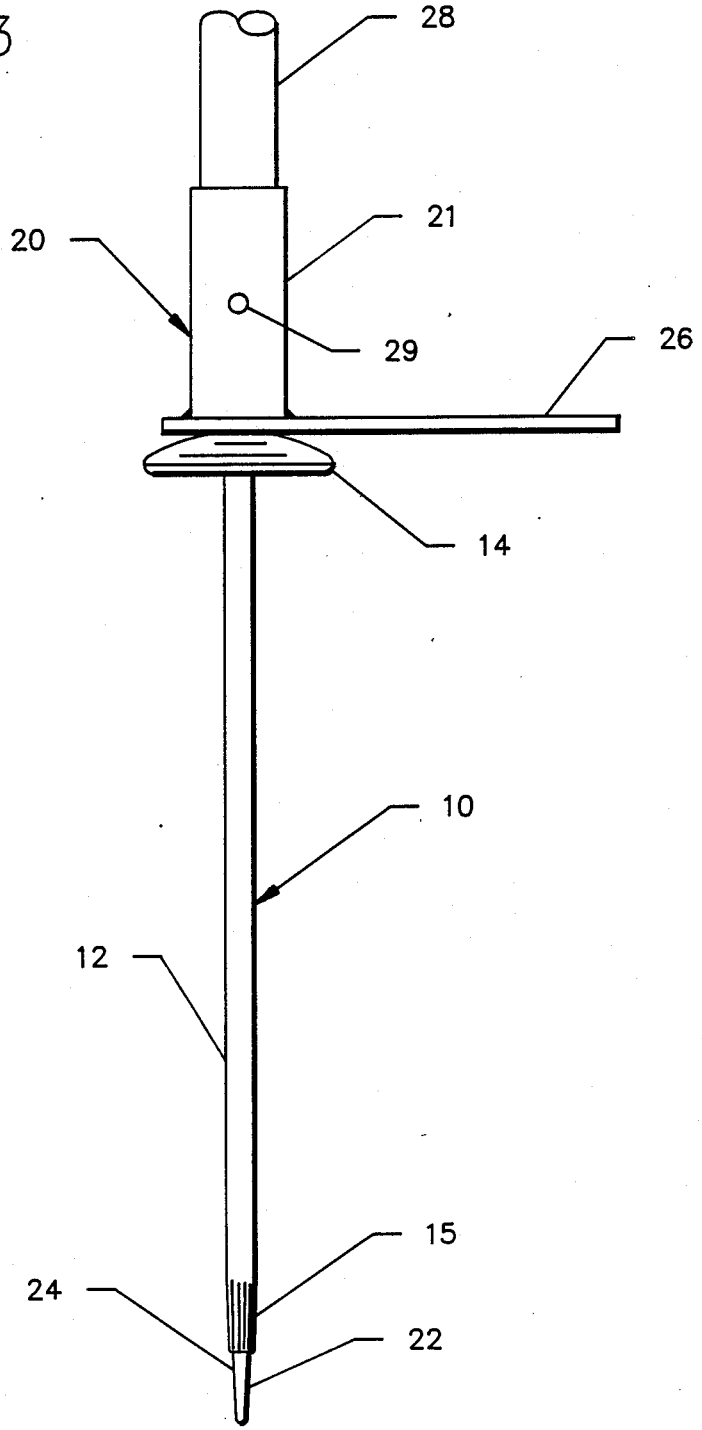

FIXATION STAKE FOR BENTHIC BARRIER

BACKGROUND

The present invention relates generally to an apparatus, method and stakes for attaching articles such as benthic barriers, ground covers, tarps, etc., to the earth.

Benthic barriers have heretofore been used to cover the bottom of a body of water to prevent the growth of aquatic weeds in the water. The present invention provides novel stakes for securing such barriers to the bottom of a body of water along with an apparatus and method for installing the same. The invention may be employed also to secure ground cover, tarps or barriers over inclines along highways, railways, etc. to prevent erosion or landslides.

It has been known to apply barriers such as woven fiberglass to the bottom of a body of water. See U.S. Pat. No. 4,056,936 to J. R. Mayer, issued Nov. 4, 1977. Said patent also teaches the use of stakes to secure the barrier to the body of water. Similar benthic barriers are disclosed in U.S. Pat. No. 4,518,280, issued to E. L. Fletcher on May 21, 1985. Erosion control barriers which are affixed to an embankment with stakes have also hithertofore been used. See for example U.S. Pat. No. 1,026,616, issued to E. P. Stratton on May 14, 1912.

The present invention provides a new and improved stake, apparatus and method which can be applied to any of the barriers disclosed in said prior art. The stakes of the present invention are thin-walled and are made of a material which is environmentally safe and also safe insofar as it will not damage the feet of people or animals who might inadvertently step on the stakes.

It has heretofore been suggested that stakes or fastener elements can be inserted in the ground by the use of a foot-operated machine. See for example U.S. Pat. No. 4,706,864, issued to W. N. Jacobsen, etal., issued Nov. 17, 1987. The stakes in conjunction with said implanting machine, however, are necessarily of a flat configuration in the nature of staples. The present invention, however, in contrast relates to hollow body stakes which in spite of walls and small mass can nonetheless readily inserted in the ground using the apparatus of the present invention.

SUMMARY OF THE INVENTION

The present invention relates to improved fixation stakes for securing articles such as benthic barriers for aquatic weed control or erosion control fabrics to the earth which stakes are formed of an elongated hollow, thin-walled plastic body portion and an enlarged head portion secured to one end thereof. The body portion and head portion have a concentric bore so that the stake may be slipped over an insertion rod which forms a part of the apparatus of this invention. The principle object of this invention is to provide a novel foot operated apparatus for implanting thin-walled, light weight, elongated hollow plastic fastener elements into the ground.

Further objects and advantages of the invention will be apparent from the following detailed description and the accompanying drawings.

DESCRIPTION OF THE DRAWINGS

FIG. 3 is a side view of the installer apparatus of this invention with the handle broken away and with a stake of the invention in position thereon for installation.

DETAILED DESCRIPTION

Figure 1:
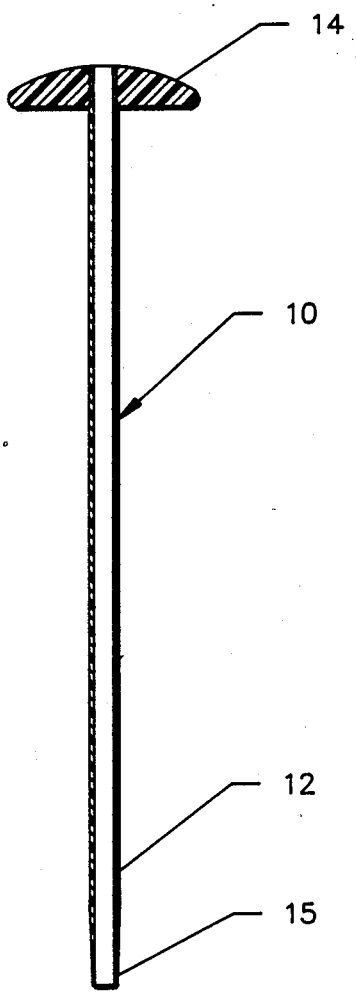
FIG. 1 is a cross-sectional view of a stake of the present invention.

Referring firstly to FIG. 1, there is shown a stake 10 of this invention which includes an elongated hollow tubular body portion 12 and an enlarged head portion 14. The elongated body portion 12 is preferably tapered toward the end 15 to facilitate insertion into the ground.

Elongated body portion is preferably formed of extruded plastic materials such as polypropylene, nylon or high density polyethylene. Enlarged top 14 may be threaded onto the upper end of hollow body portion 10 or other means of fixing such as provision of a snap on construction or thermal welding may be employed. The enlarged head portion may be formed of a similar material or other, preferably more rigid materials such as wood or harder plastic materials.

Figure 2:
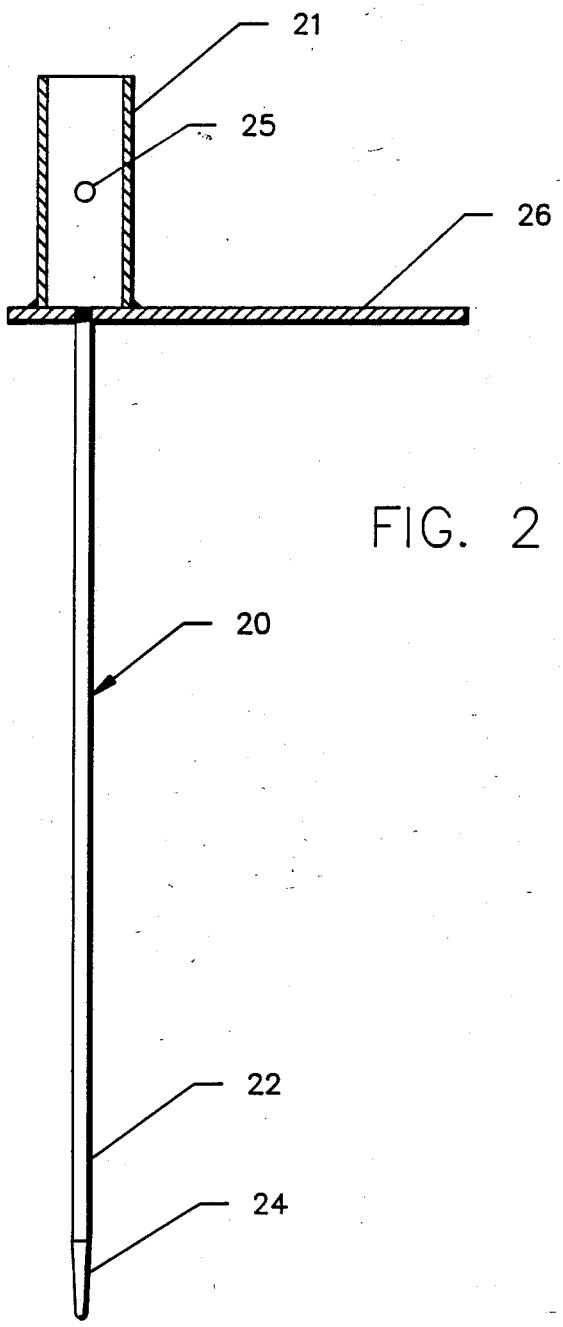
FIG. 2 is a side view of the installer apparatus of the present invention with the handle removed and parts in cross section.

Elongated hollow stem 12 is of a relatively thin-walled and formed of a relatively low strength material which would not be expected to be capable of being driven into the ground. However, in connection with the insertion apparatus generally indicated by number 20 in FIGS. 2 and 3 the stakes can be readily inserted into the ground, particularly into the bottom of a body of water or a hillside if it has been recently excavated. Insertion apparatus 20 consists of an elongated rod portion 22 which is of a diameter such that tubular body portion 12 of stake 10 can be slipped over the same. The lower end 24 of rod 22 is preferably tapered as shown in FIGS. 2 and 3 to facilitate insertion of the stake into the ground. Installer 20 comprises an upper body portion 21 which is preferably of a hollow tubular configuration to provide for mounting of the handle thereon. Provision, such as hole 25, for attachment of a handle can be provided. Integral with rod portion 22 and body portion 21 is a pedal 26. Handle 28 may be attached to body portion 21 by means of a pin or bolt 29 or other conventional connecting means.

Hollow stem 12 is shown as having a straight walled, smooth surface. However, stem 12 may be formed with ribs or projections such as barbs, in order to increase the resistance of the stakes to being removed from the ground after installation. In another embodiment holes may be provided through the sides of the stem to increase resistance to removal, which may be achieved by plant root ingrowth or settling of soil into the tube through such openings when the stake is removed.

It is preferred that the hollow stem portion of the stake be relatively slender i.e., less than about 1.3 cm in diameter. A particularly suitable size for the stakes has been found to be 0.95 cm outer diameter with a central bore of 0.64 cm and length of about 30 cm. A diameter for the head portion of about 5 to 7 cm has been found suitable.

It will be apparent that operation of the apparatus is quite simple. The apparatus with stake in place as shown in FIG. 3 can be driven partially into the ground by forceably driving the same using handle 28. The stakes either can be driven through a benthic barrier by puncturing the same in cases where the barrier is of a tear-resistant structure such as non-woven fabric. Otherwise, if desired, the barrier or fabric may be provided with holes and/or grommets for passage of the stakes therethrough. Insertion of the stake into the ground is completed by applying sufficient pressure and/or blows by foot to foot peddle 26 in order to drive the stake securely into the bottom of the body of water. The device can be similarly operated if it is desired to attach an article such as a fabric or tarp to the ground outside of a body of water. When the insertion apparatus is retracted the stake remains securely in the ground.

It is to be understood that the foregoing embodiments are to be considered illustrative of the invention. Various modifications, changes or alterations of the invention disclosed herein may be evident to those skilled in the art and thus the invention disclosed herein is not intended to be limited by the description hereinabove but rather, is intended to be limited only by the appended claims.

That which is claimed is:

1. Apparatus for installing thin-walled hollow tubular stakes into the earth comprising an upright handle portion, a horizontally extending foot pedal at the base of said portion suitable for application to said apparatus of downward driving pressure and a downwardly extending rigid solid rod integral with said handle portion adapted to receive thereon a hollow tubular stake for implantation into the earth by application of pressure to said horizontal member, said rod having a length slightly greater than said stakes.

2. Apparatus of claim 1 wherein the opposite end of said rod which is not attached to said handle portion is tapered.

3. A method of securing an article to the earth comprising placing said article in proximity to a portion of the earth which has neither been perforated nor recently excavated, providing a stake in the form of a straight, elongated thin-walled plastic tube having an enlarged head portion at one end thereof, providing an apparatus which comprises an upright handle portion, a horizontally extending foot pedal at the base of said portion suitable for application to said device of downward driving pressure by a foot, and a downwardly extending rigid solid rod integral with said handle portion, placing said hollow tubular stake over said rod with said enlarged portion up and with the end of said rod protruding through the end of said tube opposite said enlarged bead, inserting said rod through a portion of said article and applying foot pressure to said horizontal member to drive said stake into the ground, and then withdrawing said apparatus.

* * * * *